US010420411B2

(12) United States Patent
Abass

(10) Patent No.: US 10,420,411 B2
(45) Date of Patent: Sep. 24, 2019

(54) RETRACTABLE SHOULDER STRAP FOR TOWING WHEELED LUGGAGE

(71) Applicant: Retra Products, LLC, Galena, OH (US)

(72) Inventor: Omar Nabil Abass, Galena, OH (US)

(73) Assignee: RETRA PRODUCTS, LLC, Galena, OH (US)

( * ) Notice: Subject to any disclaimer, the term of this patent is extended or adjusted under 35 U.S.C. 154(b) by 0 days.

(21) Appl. No.: 15/961,814

(22) Filed: Apr. 24, 2018

(65) Prior Publication Data

US 2018/0303225 A1 Oct. 25, 2018

Related U.S. Application Data

(60) Provisional application No. 62/488,937, filed on Apr. 24, 2017.

(51) Int. Cl.

| | |
|---|---|
| ***A45C 13/30*** | (2006.01) |
| ***A45F 3/04*** | (2006.01) |
| ***A45C 13/26*** | (2006.01) |
| ***A45C 5/14*** | (2006.01) |
| ***A45C 13/38*** | (2006.01) |

(52) U.S. Cl.

CPC ..... *A45F 3/047* (2013.01); *A45C 5/14* (2013.01); *A45C 13/262* (2013.01); *A45C 13/30* (2013.01); *A45C 13/38* (2013.01)

(58) Field of Classification Search

CPC ..... A45F 5/004; A45F 2005/1073; A45C 2013/303; A45C 13/30; A45C 13/262

USPC ..... 224/162

See application file for complete search history.

(56) References Cited

U.S. PATENT DOCUMENTS

| | | | | |
|---|---|---|---|---|
| 3,924,872 | A * | 12/1975 | Sollazzi | A45C 13/262 190/18 A |
| 4,977,860 | A * | 12/1990 | Harwell | A01K 27/004 119/794 |
| 5,354,131 | A * | 10/1994 | Mogil | A45C 7/0086 150/109 |
| 9,623,806 | B2 * | 4/2017 | Rodriguez | B60R 7/043 |
| 2002/0144376 | A1 * | 10/2002 | Lee | A45C 13/28 16/114.1 |

(Continued)

FOREIGN PATENT DOCUMENTS

BR 200700886 A * 10/2008

*Primary Examiner* — Scott T McNurlen

(57) ABSTRACT

A retractable shoulder strap for towing wheeled luggage with minimal to no hand assistance and that can be easily stored and worn comfortably. The retractable shoulder strap includes a housing, a retraction mechanism, a shoulder strap, a strap-adjustment slide, an elastic strap, and a handle-attaching system. The housing contains and conceals the retraction mechanism. The retractions mechanism allows the shoulder strap to be automatically retracted into the housing when not be utilized by the user. The shoulder strap allows the user to carry a load on his or her shoulder. The strap-adjustment slide allows the user to adjust the length of the shoulder strap, when extended from inside the housing. The elastic strap absorbs shocks produced when the user is towing wheeled luggage. The handle-attaching system allows the user to attach the retractable shoulder strap to a handle of wheeled luggage.

18 Claims, 6 Drawing Sheets

(56) References Cited

U.S. PATENT DOCUMENTS

| | | | | |
|---|---|---|---|---|
| 2008/0116028 | A1* | 5/2008 | Gold | A45C 13/30<br>190/18 A |
| 2017/0369274 | A1* | 12/2017 | Joyner | A45C 13/30 |

* cited by examiner

RETRACTABLE SHOULDER STRAP FOR TOWING WHEELED LUGGAGE

The current application claims a priority to the U.S. Provisional Patent application Ser. No. 62/488,937 filed on Apr. 24, 2017.

FIELD OF THE INVENTION

The present invention relates to load carrying shoulder straps. More specifically, the present invention is a retractable shoulder strap that allows a single user to tow wheeled luggage with minimal to no-hand assistance. The present invention allows the shoulder strap to be stored easily, worn comfortably, and removed effortlessly.

BACKGROUND OF THE INVENTION

Modern day travel can be somewhat hectic nowadays, especially air travel. More people are travelling by air now than ever before. Long layovers, gate changes, and plane transfers can make travelers exhausted. With extra charges for checked bags, people are trying to carry on as much as possible. When carrying on luggage, the cost and wait for checked baggage to be unloaded is avoided. This may sound like a good idea, but it can lead to problems when navigating through the busy airport. More luggage to carry means more effort used while traveling through the terminal, which can be very draining to the body.

With traditional rolling luggage, one hand must be used to pull the bag. This restricts the amount of other luggage and items that could be carried with this hand. Besides impeding one hand, pulling rolling luggage can be physically tiring on the body. More often than not, the handle on the rolling luggage is in an awkward place and requiring a constant pull by hand. There are many lines at the airport so stop-and-go movement is very common, in addition to the long walks between terminals. This takes a toll on one's body because each time the person is moving; they have to be pulling the weight of the rolling luggage using the arm, neck and shoulder muscles of the right or left side of the body. This can lead to short term arm, shoulder and neck muscle soreness while travelling and long term back and neck problems as the frequent traveler is not walking with a straight posture due to pulling weight on one side more often than the other.

A solution to this problem is to use luggage shoulder straps. These straps allow for a hands-free method of pulling the bag using the torso instead of the hand as the strap is worn around the opposite shoulder and chest. But prior versions of luggage shoulder straps to pull carry-on luggage hands free require a large amount of effort to use. For example, both hands are needed to attach and detach the strap or harness each time that it is worn or taken off. When not in use, these bulky straps take up space and present a hazard of getting tangled or snagged from other bags in close proximity.

The present invention provides a retractable strap that reduces the fatigue associated with pulling wheeled luggage and provides a solution to the common problems associated with luggage shoulder straps. The present invention incorporates a self-retracting mechanism to return the strap to a compact configuration when not in use. This eliminates the problem of having to use both hands to attach the strap or to untangle it. The hands-free method reduces the need to hold the rolling luggage handle while moving. The strap is also physically connected to the luggage, reducing the risk of forgotten or stolen property. Lastly, the present invention provides a compact and quick method of storing the strap saving time, effort, and space.

DETAIL DESCRIPTIONS OF THE INVENTION

Figure 1:
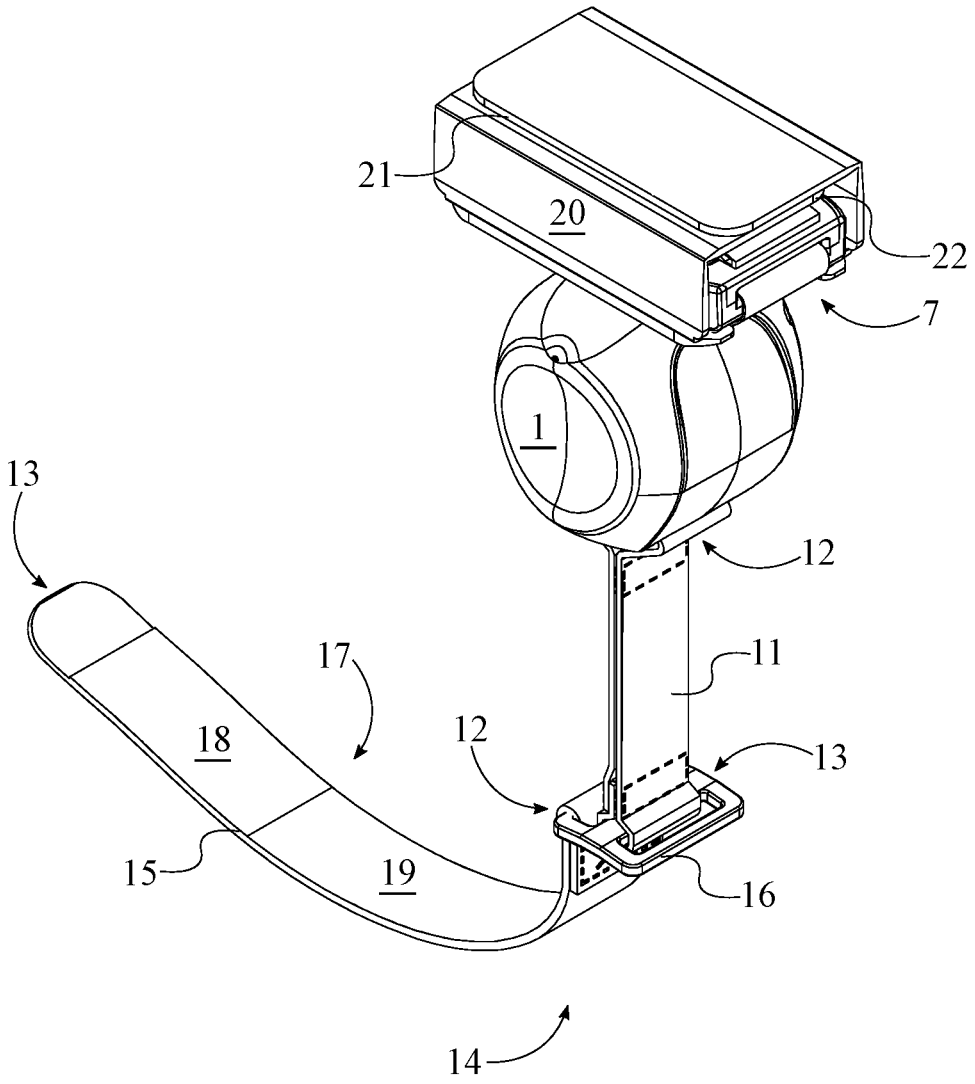
FIG. 1 is a front perspective view of the present invention.

All illustrations of the drawings are for the purpose of describing selected versions of the present invention and are not intended to limit the scope of the present invention.

In reference to FIGS. 1 through 6, the present invention is a retractable shoulder strap for towing wheeled luggage. The present invention comprises a housing 1, a retraction mechanism 3, a shoulder strap 6, a strap-adjustment slide 7, an elastic strap 11, and a handle-attaching system 14. The housing 1 contains and conceals the retraction mechanism 3. The retraction mechanism 3 allows the shoulder strap 6 to be automatically retracted into the housing 1 when the shoulder strap 6 is not being extended by the user. The shoulder strap 6 allows the user to carry a load over his or her shoulder. The strap-adjustment slide 7 allows the user to adjust the length of the shoulder strap 6 when extended from the housing 1. The elastic strap 11 allows the present invention to absorb shocks which are produced when towing wheeled luggage. The handle-attaching system 14 allows the user to attach the present invention to the handle of wheeled luggage.

Figure 4:
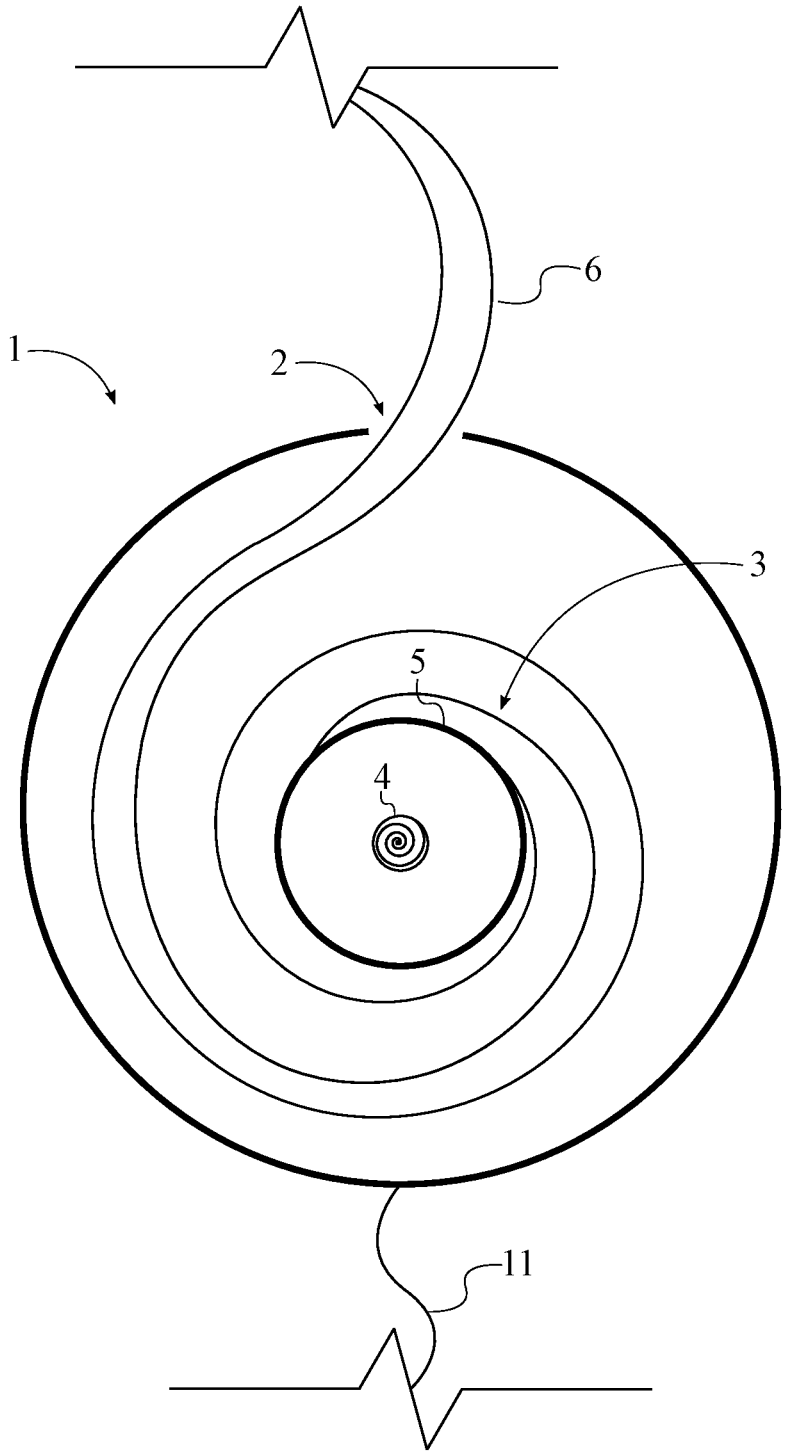
FIG. 4 is a schematic diagram of the inside of the housing of the present invention.

The general configuration of the aforementioned components allows the present invention to tow wheeled luggage with minimal to no hand assistance. The present invention further allows the load carrying means to be stored easily, worn comfortably, and removed effortlessly. As seen in FIGS. 1 and 4, the retraction mechanism 3 is positioned within the housing 1 in order to anchor the retraction mechanism 3 to the present invention. The housing 1 may also be composed of any rigid material that can protect the retraction mechanism 3 from external damage. The housing 1 may be composed of any material which is rigid in order to prevent the retraction mechanism 3 from being damaged if the present invention is accidentally dropped. The shoulder strap 6 is operatively coupled to the retraction mechanism 3, wherein the retraction mechanism 3 is used to selectively release the shoulder strap 6 from the housing 1 and is used to retract the shoulder strap 6 into the housing 1. The shoulder strap 6 can be extended out of the housing 1 by the user, and the shoulder strap 6 is automatically retracted into the housing 1 when the shoulder strap 6 is released by the user. This additionally allows the user to easily store the present invention without the shoulder strap 6 being tangled in the process. The shoulder strap 6 is engaged through the strap-adjustment slide 7. When the shoulder strap 6 is extended out from the housing 1, the length of the shoulder strap 6 can be adjusted through the strap-adjustment slide 7. The strap-adjustment slide 7 additionally is a grasping element that allows the user to easily extend the shoulder strap 6 out from the housing 1. The handle-attaching system 14 is tethered to the housing 1 by the elastic strap 11. This arrangement allows shocks, produced from towing wheel luggage, to be absorbed by the elastic strap 11, which prevents the user from experiencing the shocks through the shoulder strap 6.

As seen in FIG. 4, the housing 1 may comprise at least one exit slot 2. The at least one exit slot 2 allows the shoulder strap 6 to be extended from inside the housing 1. The retraction mechanism 3 comprises a spring 4 and a roller 5. The roller 5 is a cylindrically shaped structure that is rotatably mounted within the housing 1. The spring 4 is a torsional spring that is torsionally coupled in between the roller 5 and the housing 1. The shoulder strap 6 is laterally connected to the roller 5. In more detail, the ends of the shoulder strap 6 are laterally connected to the The shoulder strap 6 wraps around the roller 5 when the spring 4 is returned to its equilibrium state, providing a torsion force to the roller 5. The shoulder strap 6 traverses out of the at least one exit slot 2 in order to be easily extended from the housing 1.

Figure 2:
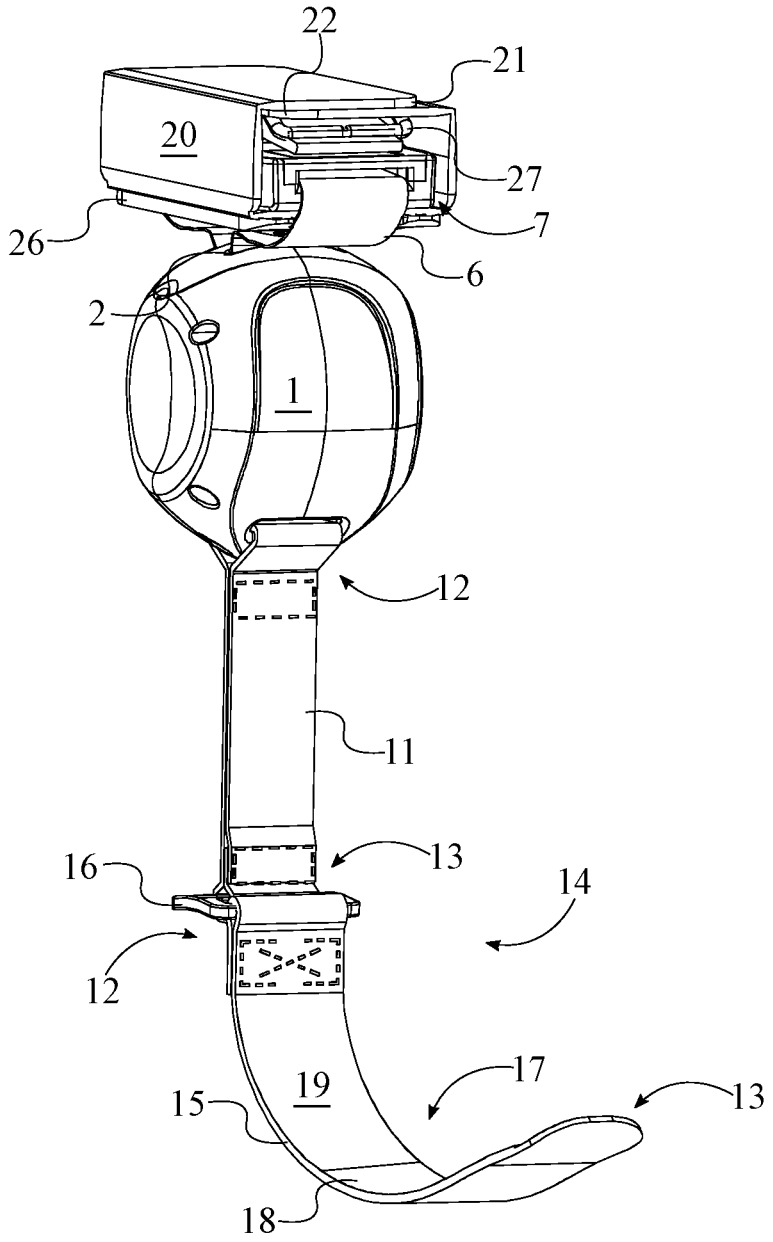
FIG. 2 is a rear perspective view of the present invention.
Figure 3:
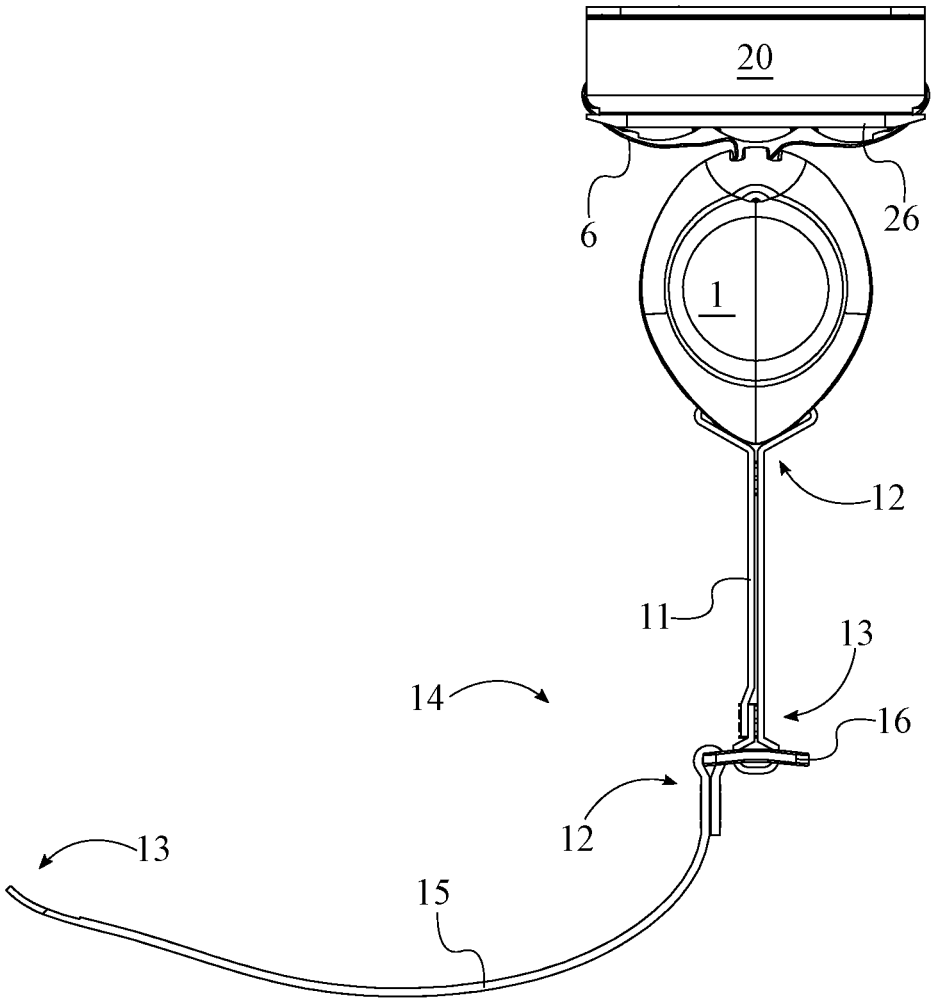
FIG. 3 is a side view of the present invention.

As seen in FIGS. 1 and 2, the handle-attaching system 14 may comprise a fastening strap 15 and a strap buckle 16. The fastening strap 15 allows the user to attach the present invention to a handle of wheeled luggage. The strap buckle 16 allows the user to easily attach the fastening strap 15 to the handle of wheeled luggage. The elastic strap 11 and the fastening strap 15 each comprise a proximal end 12 and a distal end 13. The proximal end 12 of the elastic strap 11 is externally connected to the housing 1. The distal end 13 of the elastic strap 11 is pivotably connected to the strap buckle 16. This arrangement allows the elastic strap 11 to effectively absorb shocks which are produced when towing wheeled luggage. The proximal end 12 of the fastening strap 15 is pivotably connected to the strap buckle 16. The proximal end 12 of the fastening strap 15 is positioned offset from the distal end 13 of the elastic strap 11. This arrangement allows the fastening strap 15 to be readily available to the user when attaching the present invention to wheeled luggage.

The distal end 13 of the fastening strap 15 is free when the present invention is not attached to wheeled luggage. When the user attaches the present invention to wheeled luggage, the distal end 13 of the fastening strap 15 is engaged into the strap buckle 16. The distal end 13 of the fastening strap 15 is positioned offset from the distal end 13 of the elastic strap 11, opposite the proximal end 12 of the fastening strap 15. This arrangement allows the fastening strap 15 to be wrapped around the handle of wheel luggage in order to attach the present invention.

As seen in FIG. 1, the present invention may further comprise a strap fastener 17. The strap fastener 17 allows the present invention to be secured to the handle of wheeled luggage. The strap fastener 17 comprises a first interlocking piece 18 and a second interlocking piece 19. The strap fastener 17 may be any type of fastener such as, but not limited to, a hook-and-loop fastener or magnet fastener. The first interlocking piece 18 and the second interlocking piece 19 of the strap fastener 17 can be engaged to each other. The first interlocking piece 18 and the second interlocking piece 19 of the strap fastener 17 are laterally connected to the fastening strap 15. The first interlocking piece 18 and the second interlocking piece 19 of the strap fastener 17 are positioned adjacent to each other along the fastening strap 15. This arrangement allows the fastening strap 15 to be wrapped around the handle of wheeled luggage to be fastened to itself. The fastening strap 15 may additionally include a silicone backing which would be positioned opposite to the strap fastener 17. The silicone backing keeps the fastening strap 15 in place and prevents the fastening strap 15 from moving along the handle of wheeled luggage.

Figure 6:
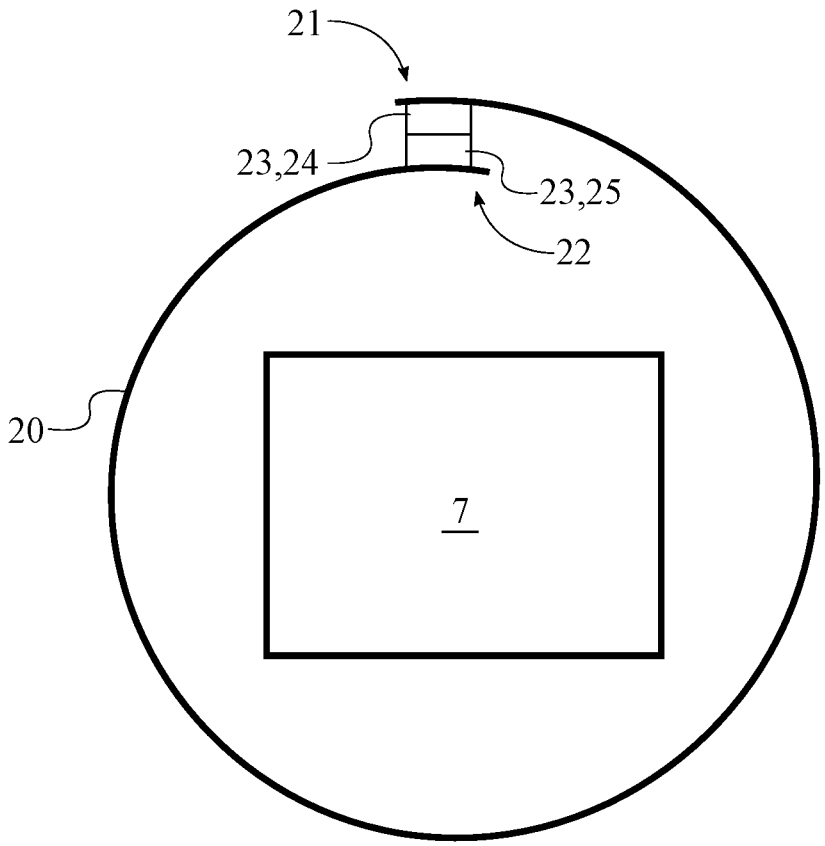
FIG. 6 is a schematic diagram of the arrangement between the cover and the strap-adjustment slide of the present invention.

As seen in FIGS. 2 and 6, the present invention may further comprise a cover 20. The cover 20 conceals the strap-adjustment slide 7 and provides a comfortably gripping element for the user when extending the shoulder strap 6 from inside the housing 1. The cover 20 comprises a first free edge 21 and a second free edge 22. The cover 20 is laterally mounted around the strap-adjustment slide 7. The first free edge 21 and the second free edge 22 are positioned opposite to each other across the cover 20. The first free edge 21 is attached along the second free edge 22. This arrangement allows the cover 20 to wrap around the strap-adjustment slide 7 in order to conceal the strap-adjustment slide 7.

As seen in FIG. 6, the present invention may further comprise a cover fastener 23. The cover fastener 23 allows the cover 20 to be securely wrapped around the strap-adjustment slide 7. The cover fastener 23 may be any type of fastener such as, but not limited to, a hook-and-loop fastener or a magnet fastener. The cover fastener 23 comprises a first interlocking piece 24 and a second interlocking piece 25. The first interlocking piece 24 and the second interlocking piece 25 of the cover fastener 23 can be engaged to each other. The first interlocking piece 24 of the cover fastener 23 is connected along the first free edge 21. The second interlocking piece 25 is connected along the second free edge 22. The first interlocking piece 24 is attached along the second interlocking piece 25. This arrangement allows the cover 20 to be secured around the strap-adjustment slide 7 and conceals the shoulder strap 6 when the user needs to wear the shoulder strap 6.

As seen in FIG. 2, the present invention may further comprise a comfort pad 26. The comfort pad 26 provides a comfortable surface to make contact with the shoulder of the user when the user is towing wheeled luggage. The comfort pad 26 may be composed of any material such as, but not limited to, rubber. The comfort pad 26 is connected onto the cover 20, opposite the strap-adjustment slide 7. This arrangement positions the comfort pad 26 in order to make contact with the shoulder of the user.

Figure 5:
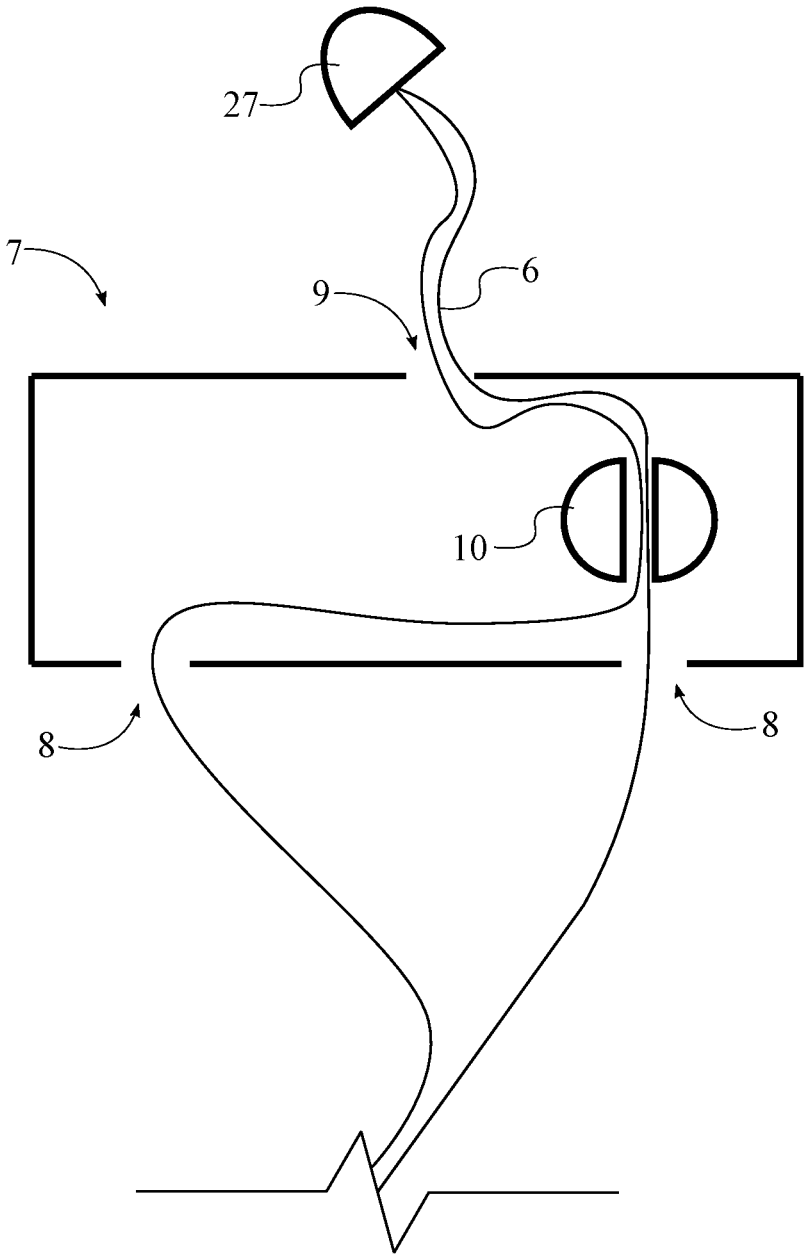
FIG. 5 is a schematic diagram of the inside of the strap-adjustment slide of the present invention.

As seen in FIG. 5, the strap-adjustment slide 7 comprises at least one strap entrance 8, at least one strap exit 9, and a clasp 10. The at least one strap entrance 8 is operatively coupled to the clasp 10, wherein the at least one strap entrance 8 is used to guide the shoulder strap 6 into the clasp 10. The clasp 10 is operatively coupled to the at least one strap exit 9, wherein the at least one strap exit 9 is used to guide the shoulder strap 6 out of the clasp 10. When the shoulder strap 6 is extended from inside the housing 1, the length of the shoulder strap 6 can be adjusted utilizing the strap-adjustment slide 7. The user can pull the shoulder strap 6 through the strap-adjustment slide 7 via the at least one strap entrance 8 and can lock the strap in place utilizing the clasp 10.

As seen in FIG. 5, the present invention may further comprise a D-ring 27. The D-ring 27 provides a means of leverage when adjusting the shoulder strap 6 through the strap-adjustment slide 7. The D-ring 27 is terminally coupled to the shoulder strap 6, adjacent to the at least one strap exit 9. In more detail, the shoulder strap 6 is a continuous strap that is folded in half. One end of the shoulder strap 6 is the two free ends of the continuous strap and is connected to the roller 5. The other end of the shoulder strap 6 is the central fold of the continuous strap and is coupled to the D-ring 27. This arrangement allows the user to easily pull the shoulder strap 6 through the strap-adjustment slide 7 and visually determine the length of the shoulder strap 6. The shoulder strap 6, once adjusted to its desired length by utilizing the clasp 10 to lock the shoulder strap 6 in place, can be tucked inside the cover 20.

Although the invention has been explained in relation to its preferred embodiment, it is to be understood that many other possible modifications and variations can be made without departing from the spirit and scope of the invention as hereinafter claimed.

What is claimed is:

1. A retractable shoulder strap for towing wheeled luggage comprises:

a housing;

a retraction mechanism;

a shoulder strap;

a strap-adjustment slide;

an elastic strap;

a handle-attaching system;

the retraction mechanism being positioned within the housing;

the shoulder strap being operatively coupled to the retraction mechanism, wherein the retraction mechanism is used to selectively release the shoulder strap from the housing and is used to retract the shoulder strap into the housing;

the shoulder strap being engaged through the strap-adjustment slide;

the handle-attaching system being tethered to the housing by the elastic strap;

the strap-adjustment slide comprises at least one strap entrance, at least one strap exit, and a clasp;

the at least one strap entrance being operatively coupled to the clasp, wherein the at least one strap entrance is used to guide the shoulder strap into the clasp; and the clasp being operatively coupled to the at least one strap exit, wherein the at least one strap exit is used to guide the shoulder strap out of the clasp.

2. The retractable shoulder strap as claimed in claim 1 comprises:

the housing comprises at least one exit slot;

the retraction mechanism comprises a spring and a roller;

the roller being rotatably mounted within the housing;

the spring being torsionally coupled in between the roller and the housing;

the shoulder strap being laterally connected to the roller; and the shoulder strap traversing out of the at least one exit slot.

3. The retractable shoulder strap as claimed in claim 1 comprises:

the handle-attaching system comprises a fastening strap and a strap buckle;

the elastic strap and the fastening strap each comprise a proximal end and a distal end;

the proximal end of the elastic strap being externally connected to the housing;

the distal end of the elastic strap being pivotably connected to the strap buckle;

the proximal end of the fastening strap being pivotably connected to the strap buckle; and the proximal end of the fastening strap being positioned offset from the distal end of the elastic strap.

4. The retractable shoulder strap as claimed in claim 3 comprises:

the distal end of the fastening strap being engaged into the strap buckle; and the distal end of the fastening strap being positioned offset from the distal end of the elastic strap, opposite the proximal end of the fastening strap.

5. The retractable shoulder strap as claimed in claim 3 comprises:

a strap fastener;

the strap fastener comprises a first interlocking piece and a second interlocking piece;

the first interlocking piece and the second interlocking piece being laterally connected to the fastening strap; and the first interlocking piece and the second interlocking piece being positioned adjacent to each other along the fastening strap.

6. The retractable shoulder strap as claimed in claim 1 comprises:

a cover;

the cover comprises a first free edge and a second free edge;

the cover being laterally mounted around the strap-adjustment slide;

the first free edge and the second free edge being positioned opposite to each other across the cover; and the first free edge being attached along the second free edge.

7. The retractable shoulder strap as claimed in claim 6 comprises:

a cover fastener;

the cover fastener comprises a first interlocking piece and a second interlocking piece;

the first interlocking piece being connected along the first free edge;

the second interlocking piece being connected along the second free edge; and the first interlocking piece being attached along the second interlocking piece.

8. The retractable shoulder strap as claimed in claim 6 comprises:

a comfort pad; and the comfort pad being connected onto the cover, opposite the strap-adjustment slide.

9. The retractable shoulder strap as claimed in claim 1 comprises:

a D-ring; and the D-ring being terminally coupled to the shoulder strap, adjacent to the at least one strap exit.

10. A retractable shoulder strap for towing wheeled luggage comprises:

a housing;

a retraction mechanism;

a shoulder strap;

a strap-adjustment slide;

an elastic strap;

a handle-attaching system;

a cover;

the retraction mechanism being positioned within the housing;

the shoulder strap being operatively coupled to the retraction mechanism, wherein the retraction mechanism is used to selectively release the shoulder strap from the housing and is used to retract the shoulder strap into the housing;

the shoulder strap being engaged through the strap-adjustment slide;

the handle-attaching system being tethered to the housing by the elastic strap;

the cover comprises a first free edge and a second free edge;

the cover being laterally mounted around the strap-adjustment slide;

the first free edge and the second free edge being positioned opposite to each other across the cover;

the first free edge being attached along the second free edge.

11. The retractable shoulder strap as claimed in claim 10 comprises:

the housing comprises at least one exit slot;

the retraction mechanism comprises a spring and a roller;

the roller being rotatably mounted within the housing;

the spring being torsionally coupled in between the roller and the housing;

the shoulder strap being laterally connected to the roller; and the shoulder strap traversing out of the at least one exit slot.

12. The retractable shoulder strap as claimed in claim 10 comprises:

the handle-attaching system comprises a fastening strap and a strap buckle;

the elastic strap and the fastening strap each comprise a proximal end and a distal end;

the proximal end of the elastic strap being externally connected to the housing;

the distal end of the elastic strap being pivotably connected to the strap buckle;

the proximal end of the fastening strap being pivotably connected to the strap buckle; and the proximal end of the fastening strap being positioned offset from the distal end of the elastic strap.

13. The retractable shoulder strap as claimed in claim 12 comprises:

the distal end of the fastening strap being engaged into the strap buckle; and the distal end of the fastening strap being positioned offset from the distal end of the elastic strap, opposite the proximal end of the fastening strap.

14. The retractable shoulder strap as claimed in claim 12 comprises:

a strap fastener;

the strap fastener comprises a first interlocking piece and a second interlocking piece;

the first interlocking piece and the second interlocking piece being laterally connected to the fastening strap; and the first interlocking piece and the second interlocking piece being positioned adjacent to each other along the fastening strap.

15. The retractable shoulder strap as claimed in claim 10 comprises:

a cover fastener;

the cover fastener comprises a first interlocking piece and a second interlocking piece;

the first interlocking piece being connected along the first free edge;

the second interlocking piece being connected along the second free edge; and the first interlocking piece being attached along the second interlocking piece.

16. The retractable shoulder strap as claimed in claim 10 comprises:

a comfort pad; and the comfort pad being connected onto the cover, opposite the strap-adjustment slide.

17. The retractable shoulder strap as claimed in claim 10 comprises:

the strap-adjustment slide comprises at least one strap entrance, at least one strap exit, and a clasp;

the at least one strap entrance being operatively coupled to the clasp, wherein the at least one strap entrance is used to guide the shoulder strap into the clasp; and the clasp being operatively coupled to the at least one strap exit, wherein the at least one strap exit is used to guide the shoulder strap out of the clasp.

18. The retractable shoulder strap as claimed in claim 17 comprises:

a D-ring; and the D-ring being terminally coupled to the shoulder strap, adjacent to the at least one strap exit.

* * * * *